United States Patent [19]

Maass

[11] Patent Number: 4,662,084

[45] Date of Patent: May 5, 1987

[54] ELECTRIC HAIR DRYER WITH AIR DISPERSING HOOD

[75] Inventor: Rudolf Maass, Solingen, Fed. Rep. of Germany

[73] Assignee: Robert Krups Stiftung & Co. KG., Solingen, Fed. Rep. of Germany

[21] Appl. No.: 868,329

[22] Filed: May 29, 1986

[30] Foreign Application Priority Data

Jul. 31, 1985 [DE] Fed. Rep. of Germany ..... 3527313

[51] Int. Cl.[4] ..... A45D 20/24

[52] U.S. Cl. ..... 34/99; 219/369; 219/370

[58] Field of Search ..... 34/99, 100; 219/369, 219/370, 371, 372

[56] References Cited

U.S. PATENT DOCUMENTS 4,038,759 8/1977 Dyer et al. ..... 34/99

*Primary Examiner*—Larry I. Schwartz

*Attorney, Agent, or Firm*—Peter K. Kontler

[57] ABSTRACT

The housing of the apparatus which supplies conditioned air into the plenum chamber of the collapsible hood of an electric hair dryer has integral internal ribs which define a channel for the flow of air past an air heating device and toward an impeller which is driven by an electric motor and conveys conditioned air into the hood. Four walls of the housing have air admitting ports, and the ribs define with the bearing for the electric motor an annular gap for admission of air from the interior of the housing into an intermediate portion of the channel. The inlet of the channel is defined by outwardly flaring arcuate end portions of the ribs.

13 Claims, 3 Drawing Figures

58
60
47
48
44
50
42
45
43
51
49
46
59
53
57
45
56
41
52
16a
86
92
54
40
55
90
91
C
33
38
37
87
87
88
88
39
B
89
89
11a
26a
20
29
A
36
A

ELECTRIC HAIR DRYER WITH AIR DISPERSING HOOD

CROSS-REFERENCE TO RELATED CASE

The hair dryer of the present invention constitutes an improvement over and a further development of the hair dryer which is disclosed in the commonly owned copending patent application Ser. No. 767,413 filed Aug. 20, 1985 by Gotthard Ch. Mahlich et al.

BACKGROUND OF THE INVENTION

The invention relates to hair dryers in general, and more particularly to improvements in hair dryers of the type wherein an inflatable hood can be coupled to an air supplying apparatus having a housing for an electric motor which drives an impeller to draw atmospheric air into the housing and to cause the atmospheric air to flow past an air heating device in the housing and to thereupon enter the plenum chamber whence it flows through the pores of the inner panel of the chamber and into the hair of the person wearing the hood.

The commonly owned copending patent application Ser. No. 767,413 of Mahlich et al. discloses a hair dryer wherein the housing of the air supplying apparatus is formed with a large number of ports for admission of atmospheric air into the interior of the housing. The ports can be provided in an end wall, in a front wall and in two lateral walls of the housing. Streamlets of air which enter the interior of the housing through such ports are caused to flow into a discrete (separately produced) tubular or frustoconical guide which induces the streamlets to flow toward the impeller of an air conveying unit. The impeller is driven by an electric motor and causes the air to flow into an extension of the hood on its way into the plenum chamber. A suitable air heating unit is provided in the housing to raise the temperature of air to a desired level upstream of the plenum chamber.

An advantage of the hair dryer of Mahlich et al. is that all of the air admitting ports are highly unlikely to become clogged simultaneously, even under the most adverse circumstances, so that the impeller can convey requisite quantities of conditioned air into the hood. The large number of ports entails a reduction of the speed of the streamlets of air which flow into the housing. This is desirable because the person wearing the hood is less likely to be exposed to draft.

The aforementioned guide in the housing of the air supplying apparatus of Mahlich et al. extends substantially all the way from one end wall to the other end wall of the housing, namely from the wall which is remotest from to the wall which is immediately adjacent the impeller. Furthermore, the bearing for the motor which drives the impeller has a rather long tubular component which is telescoped into an elongated portion of the guide. In one embodiment of the hair dryer of Mahlich et al., all of the air which enters the housing by way of numerous ports must enter the guide at one axial end to thereupon flow past the air heating unit and toward the impeller. Certain other embodiments of the hair dryer of Mahlich et al. employ a composite guide which is installed in the housing in such a way that it can admit air at one of its ends as well as at several locations intermediate its ends. The making and installation of a discrete guide particularly a composite guide, contribute to the initial and assembly cost of the hair dryer.

OBJECTS AND SUMMARY OF THE INVENTION

An object of the invention is to provide a hair dryer which constitutes an improvement over and a further development of the aforediscussed hair dryer in that it need not be provided with a discrete air guide.

Another object of the invention is to provide a hair dryer wherein the stremalets of air which enter through the ports of the housing of the air supplying apparatus are guided toward and into the range of the air conveying means in a novel and improved way.

A further object of the invention is to provide a novel and improved housing for the air supplying apparatus of the above outlined hair dryer.

An additional object of the invention is to provide a novel and improved air supplying apparatus for use with the collapsible hood of a hair dryer.

Still another object of the invention is to provide a novel and improved method of guiding atmospheric air in the interior of the housing of apparatus serving to supply air to the plenum chamber or chambers of a collapsible hood in an electric hair dryer.

An additional object of the invention is to provide a hair dryer wherein the bearing for the electric motor and the air guide cooperate in a novel and improved way to admit air into the path along which the air flows into the range of the rotary impeller of the means for conveying air into the plenum chamber or chambers of the hood.

The improved hair dryer comprises a hood which defines at least one plenum chamber and has a deformable foraminous panel adjacent the plenum chamber and serving to at least partially surround the hair on the head of a person wearing the hood, and an apparatus for supplying air into the plenum chamber including a housing having a plurality of walls at least one of which has ports for admission of air into the interior of the housing, means for conveying the thus admitted air from the housing into the plenum chamber, and novel and improved means for directing air which enters the housing to the conveying means. The directing means is rigid with the housing. In accordance with a presently preferred embodiment of the invention, the directing means is integral with the housing and comprises internal projections provided on the walls in the interior of the housing. Such projections define an elongated channel for the flow of air to the conveying means, and the projections can include or constitute elongated ribs.

The conveying means comprises an electric motor for a rotary impeller, and the air supplying apparatus preferably further comprises a bearing for the motor. Such bearing is installed in the housing and, in accordance with another feature of the invention, defines with the projections a clearance (e.g., an annular gap) for admission of air from the housing into an intermediate portion of the channel.

The bearing can comprise a tubular skirt and the projections can comprise end portions which are adjacent to the skirt. The clearance is then provided between such end portions and the skirt. The end portions can form a collar which surrounds a portion of the skirt.

The housing includes an end wall which is remote from the clearance, and the channel is preferably formed with an enlarged inlet which is adjacent the end wall and can be defined by outwardly flaring arcuate end portions of the projections.

The novel features which are considered as characteristic of the invention are set forth in particular in the appended claims. The improved hair dryer itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
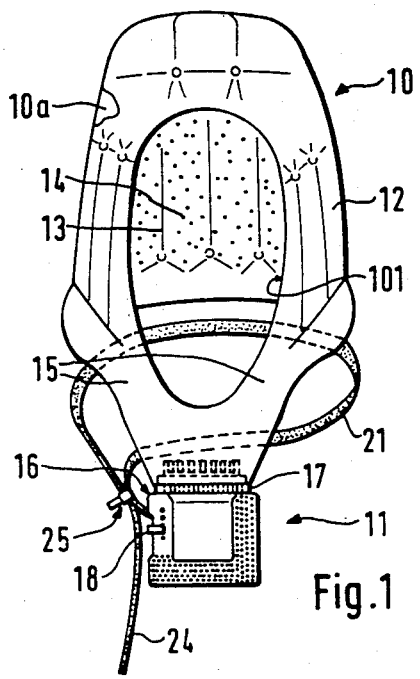
FIG. 1 is a schematic front elevational view of an electric hair dryer which embodies the invention and wherein the housing of the air supplying apparatus is separably coupled with a one-piece extension of the hood.

FIG. 1 shows an electric hair dryer which comprises a deformable hood 10 and an electrically operated air supplying apparatus 11. Switches, a cable and analogous parts are omitted for the sake of clarity; such parts can be identical with those of the hair dryer which is disclosed in the commonly owned copending patent application Ser. No. 767,413 or in a conventional hair dryer.

The hood 10 comprises an outer panel 12 whose front part defines an opening 101 for the face, nose, mouth, eyes and chin of the user, and a foraminous inner panel 13 having perforations 14 in the form of pores or the like. When not in use, the hood 10 can be collapsed into a minute package ready to be confined in a small carrying case (not shown), preferably together with the air supplying apparatus 11. FIG. 1 shows the hood 10 in expanded or inflated condition in which the plenum chamber or chambers 10*a* between its panels 12 and 13 receive heated air from the apparatus 11. Such air escapes from the plenum chamber(s) 10*a* by way of pores 14 to come in contact with the hair of the person wearing the hood 10.

The hood 10 comprises a substantially Y-shaped one-piece extension 15 which connects it with the outlet of the housing 11*a* of the air supplying apparatus 11. The two branches of the extension 15 define paths for the flow of conditioned air from the housing 11*a* into the plenum chamber(s) 10*a*. The character 17 denotes one element of a coupling device 16 whose other element 16*a* is provided on the housing 11*a* and is separably connected to the element 17 to establish a satisfactory seal against the escape of conditioned air into the surrounding atmosphere. The illustrated quick-release coupling device 16 is but one of numerous coupling devices which can be used to separably connect the housing 11*a* with the extension 15. The coupling device 16 should be capable of carrying the weight of the apparatus 11 so that the latter can be suspended on the lower end portion of the extension 15. By way of example, a rudimentary coupling device can comprise a rubber band which is installed in the lower end portion of the extension 15 and is receivable in a circumferential groove of the coupling element at the upper end of the housing 11*a*. As can be seen in FIG. 1, the housing 11*a* can be located immediately below or rather close to the chin of the person wearing the hood 10.

The housing 11*a* of the air supplying apparatus 11 carries a reciprocable or pivotable selector 18 which can be pushed or pulled into register with one of several indicia forming part of a scale 19 at the outer side of the front wall 26 of the housing 11*a*. The selector 18 extends into an internal compartment 33 of the housing 11*a* and can be manipulated by the person wearing the hood 10 or by a beautician to select the temperature of the air stream flowing into the extension 15, the rate of air flow and/or to turn on or to arrest the electric motor 40 (note FIG. 3) which drives a rotor or impeller 44 serving to draw cool atmospheric air into the compartment 33, to draw such air past an air heating unit 37, and to force the thus conditioned air into the extension 15. The construction and mode of operation of the selector 18 form no part of the present invention.

The illustrated substantially Y-shaped extension 15 can be replaced with two discrete hoses each of which conveys a stream of heated air from a discrete outlet of the housing 11*a* or an analogous housing. Such modified hair dryer will require two coupling devices, one for the lower end portion of each of the two hoses.

Figure 2:
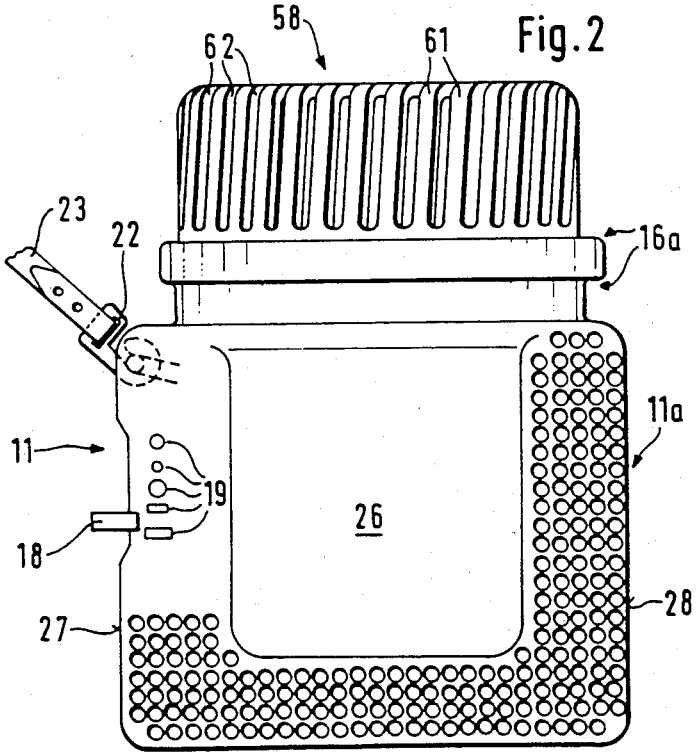
FIG. 2 is an enlarged front elevational view of the housing of the air supplying apparatus.

FIG. 1 further shows a strap 21 one end portion 23 of which is connected to a hook 22 on the housing 11*a* (see FIG. 2). The other end portion 24 of the strap 21 extends through a length-adjusting device 25. The looped intermediate portion of the strap 21 is caused to rest on the nape of the wearer of the hood 10. The end portion 23 extends through an eyelet of the hook 22 and is bent over itself to be permanently or separably secured to the hook by one or more rivets, buttons or like fasteners. The hook 22 is pivotable on a pin of the housing 11*a* in a manner not forming part of the invention. The length-adjusting device 25 can be similar to those used on the straps of photographic cameras or similar instruments. As a rule, the end portion 24 will not only fully overlie but will extend beyond the end portion 23 so as to ensure that one and the same hair dryer can be comfortably used by an obese, slim, adult or growing person. The length-adjusting device 25 can be replaced with length-adjusting devices of the type discussed in the commonly owned copending patent application Ser. No. 767,413. The illustrated device 25 has a separately produced slotted or apertured plate whose width exceeds the width of the strap 21 and which can be provided with an opening for the socket of a snap fastener. The modified length-adjusting device can be integrated into the hosuing 11*a* and can grip or release selected portions of the strap 21. The modified adjusting device preferably comprises a chamber which is installed in the housing 11*a* and contains blocking means for fixing the strap so that the latter provides a loop of desired length.

Figure 3:
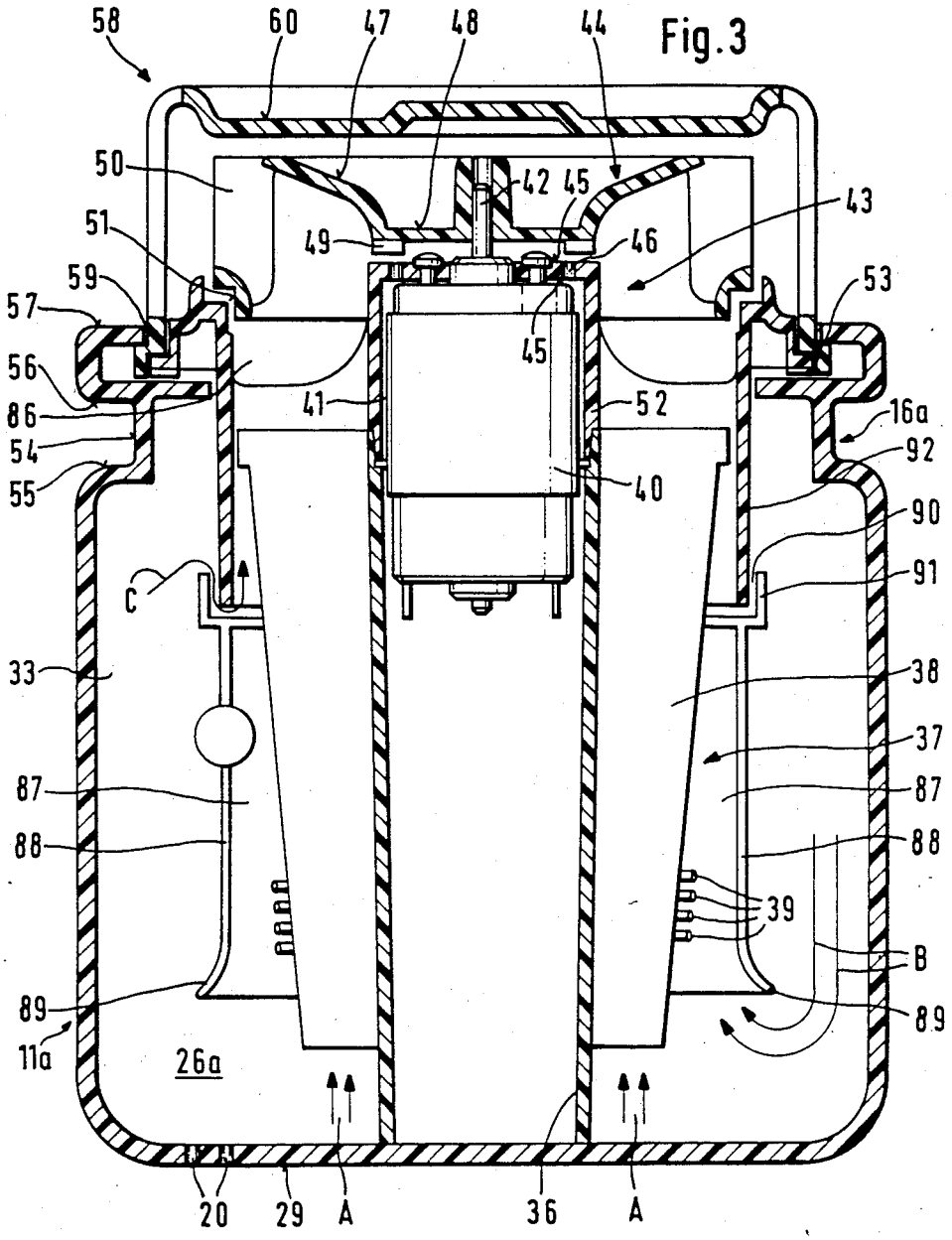
FIG. 3 is a greatly enlarged substantially central vertical sectional view of the air supplying apparatus.

FIG. 3 shows that the bottom or end wall 29 of the housing 11*a* is formed with a number of air admitting openings 20 (hereinafter called ports). Additional ports 20 are provided in the front wall 26 (see FIG. 2) and preferably also in at least one of the two lateral walls 27 and 28. The distribution of ports 20 in the walls 26–29 can be similar to or identical with that which is shown in the hair dryer of the copending patent application Ser. No. 767,413. The illustrated circular ports 20 can be replaced by or used jointly with slot-shaped or otherwise configurated ports without departing from the spirit of the invention. Moreover, uniformly distributed ports can be provided jointly with otherwise distributed ports of identical or different shape and/or size if this is desirable and/or advantageous for admission of requisite quantities of atmospheric air and/or for the appearance of the housing 11*a*. As a rule, the rear wall 26*a* (opposite the wall 26) of the housing 11*a* will be devoid of ports in order to reduce the likelihood of attracting the garment which is worn by the user of the hair dryer.

The housing 11*a* is or can be assembled of two halves or sections which are separably coupled to each other by elastic prongs provided on one section and extending into complementary sockets of the other section or in any other suitable way. As a rule, the plane wherein the two sections of the housing 11*a* abut each other will be parallel to the plane of FIGS. 1, 2 or 3. The cable (not shown) which is used to connect the motor 40 with a suitable source of electrical energy preferably extends through a hole (not shown) in the end wall 29 of the housing 11*a*. The cable is further connected with the switch or switches which can be actuated by the selector 18.

The ports 20 admit atmospheric air into the compartment 33 of the housing 11*a*, and more particularly into an air channel 87 which is provided in the housing 11*a* and surrounds the air heating unit 37. The channel 87 is bounded by air directing projections in the form of ribs 88 which are integral parts of the housing 11*a* in contrast to the separately produced guide means disclosed in the copending patent application Ser. No. 767,413. The lower end portions 89 of the ribs 88 flare outwardly in a region close to the end wall 29 so as to form a large mouth-like inlet for admission of air into the channel 87. Streamlets of air which enter the compartment 33 via ports 20 in the end wall 29 flow in the directions indicated by arrows A and enter the channel 87 without any deflection. Arrows B denote in FIG. 3 the directions of flow of streamlets of air which enter the compartment 33 via ports 20 in the walls 26, 27, 28 and are caused to flow toward and into the inlet of the channel 87. Additional air can enter the channel 87 in the directions which are indicated by an arrow C, i.e., at a considerable distance from the inlet at 89. The streamlets which are denoted by the arrow C enter the channel 87 by way of a substantially annular clearance or gap 90 which is defined by the ribs 88 and the adjacent end portion of an annular bearing 43 for the electric motor 40 of the air conveying means. The clearance 90 is defined by collar-like end portions 91 of the ribs 88 in conjunction with a tubular skirt 92 of the bearing 43. The extent to which the skirt 92 is overlapped by the collars 91 is relatively small so that these parts need not offer an excessive resistance to the flow of streamlets of air in the clearance 90.

The central portion of the compartment 33 contains a tubular cooling element 36 which can constitute a hollow cylinder or a slightly tapering conical frustum and serves to supply cool atmospheric air from certain ports 20 in the end wall 29 directly to the casing of the motor 40. One end portion of the cooling element 36 can abut the inner side of the end wall 29 and the other end portion of this cooling element is coupled to a tubular portion (e.g., a short cylinder) 52 of the bearing 43. An annular gap 41 between the casing of the motor 40 and the cylinder 52 serves to admit air from the interior of the cooling element 36 into the range of the impeller 44.

The cooling element 36 of the illustrated hair dryer constitutes a support or carrier for wedge-like insulating plates 38 forming part of the air heating unit 37 and supporting a heatable wire 39. Each of the plates 38 can be inserted into a discrete external groove of the cooling element 36. The heating action can be regulated by shifting the selector 18 to a different position so as to effect a change of the length of that portion of the wire 39 which is heated by electric current and heats the mass of air flowing in the channel 87 toward the impeller 44. The heating action can be varied stepwise or infinitely.

The bearing 43 is preferably a one-piece part made of a conventional electrically insulating material. The radially outermost portion 53 of the bearing 43 is integral with the adjacent end portion of the skirt 92 as well as with a set of substantially radially inwardly extending partitions or webs 86 which establish a rigid connection with the cylinder 52 and define a number of large passages for the flow of air from the channel 87 toward the impeller 44. The major part of the casing of the elecric motor 40 is confined in the cylinder 52 of the bearing 43. The lowermost portion of the casing of the motor 40 (as viewed in FIG. 3) extends into the adjacent end portion of the cooling element 36 so that it is contacted by inflowing unheated atmospheric air.

That end of the cylinder 52 which is remote from the cooling element 36 is integral with a platelike closing member 45 which is formed with apertures 46 to permit heated air to flow from the gap 41 toward the impeller 44. The centrally located aperture of the closing member 45 receives a portion of the rotary output element 42 of the motor 40 which drives the impeller 44. The diameter of such centrally located aperture preferably exceeds the diameters of other apertures 46.

The illustrated impeller 44 is made of a single piece of synthetic plastic material having a circumferentially complete coverplate 47 and a centrally located hub for the output element 42. The hub is connected with the coverplate 47 by a radially extending disc-shaped portion 48. That side of the disc-shaped portion 49 which faces the motor 40 is formed with an annulus of projections 49 constituting vanes or blades which draw preheated air through the apertures 46 and into the spaces between vanes 50 surrounding the coverplate 47 of the impeller 44. The radially outermost portions of the vanes 50 are connected with a rim 51 which preferably constitutes an integral part of the impeller 44. The impeller is preferably provided with an annulus of identical and uniformly spaced-apart vanes 50. The manner in which the vanes 50 can be inclined with reference to the axis of the impeller 44 is or can be the same as shown in FIG. 4 of the copending patent application Ser. No. 767,413.

The impeller 44 is mounted in the housing 11*a* downstream of the air heating unit 37 (as seen in the direction of air flow from the channel 87 toward the extension 15 of the hood 10). The heating unit 37 is surrounded by the ribs 88 of the housing 11*a*, and the impeller 44 is confined in a detachable cupped closure or cover 58 of the housing 11*a*. The placing of the impeller 44 downstream of the air heating unit 37 renders it possible to employ a large-diameter impeller.

FIG. 3 shows that the element 16*a* of the coupling device 16 comprises an external groove 54 which is flanked by two washer-like portions 55, 56 of the housing 11*a* and can receive the coupling element 17 at the free end of the extension 15 to establish a reliable seal against the escape of conditioned air into the surrounding atmosphere except along the path which is defined by the extension 15, plenum chamber(s) 10*a* and pores 14 in the inner panel 13 of the hood 10. As mentioned above, the coupling element 17 can constitute or include one or more simple rubber bands in or on the free end portion of the extension 15.

The washer-like portion 56 of the housing 11*a* merges into a rounded portion 57 whose internal surface is engaged by the outwardly extending flange 59 of the closure 58 so that the latter is detachably secured to the housing 11*a*. The closure 58 can be made of a single piece of synthetic plastic material and its flange 59 is inserted into the rounded portion 57 before the sections of the housing 11*a* are permanently or separably secured to each other. If desired, the flange 59 can be replaced with two or more elastic prongs which engage the internal surface of the rounded portion 57.

The closure 58 further comprises a top wall 60 which is disposed opposite the impeller 44 and is parallel to the plane of the flange 59. The top wall 60 has a raised central portion and a marginal portion which is connected with the flange 59 by a set of inclined ribs or bars 61 (see FIG. 2) alternating with slots 62 which admit heated air into the extension 15. The purpose of the ribs 61 is to ensure uniform distribution of conditioned air which flows into the lower end portion of the extension 15. It will be seen that, when the hood 10 is properly coupled to the housing 11*a*, the impeller 44 is located within the confines of the extension 15.

The improved hair dryer can be modified in a number of ways. For example, the ribs 88 need not extend exactly longitudinally of the cooling element 36, the number of such ribs can be increased or reduced, and the ribs can be shorter or longer than those shown in FIG. 3. Furthermore, the rate of air flow through the clarance 90 can be altered so as to enable the impeller 44 to draw larger quantities of air in the directions which are indicated by the arrow C. Still further, the flow restricting action in the region of the clearance 90 can be changed by lengthening or shortening the collar 91 and/or the portion 92 of the bearing 43.

An important advantage of the improved hair dryer is that the apparauts 11 need not be provided with a separately produced air directing device. Instead, the means for directing air into the range of the impeller 44 (i.e., of the means for conveying conditioned air into the plenum chamber 10*a*) can constitute an integral part (note the ribs 88) of the housing 11*a*. Moreover, those end portions of the ribs 88 which are remote from the end wall 29 define the aforementioned collar 91 which surrounds the adjacent end portion of the skirt 92 and defines therewith an annular clearance or gap 90 which serves to admit air from the interior of the housing 11*a* directly into an intermediate portion of the elongated channel 87 so that only a certain percentage of atmospheric air which enters the housing 11*a* via ports 20 must flow toward and into the inlet which is defined by the outwardly flaring arcuate end portions 89 of the ribs 88.

Another important advantage of the improved hair dryer is that the skirt 92 of the bearing 43 for the electric motor 40 can be used as an extension of the ribs 88 to guide conditioned air toward the vanes 50 of the impeller 44. This renders it possible to reduce the length of the ribs 88 and to thus reduce the initial cost and weight of the housing 11*a*. The collar 91 can be located well upstream of the impeller 44 and the closing member 45 since the path for the flow of air from the clearance 90 toward the impeller 44 is defined by the skirt 92 of the bearing 43. The clearance 90 renders it possible to greatly reduce the percentage of air which enters the housing 11*a* through the ports of the walls 26, 27, 28 and must flow toward the inlet of the channel 87 to be deflected through 180 degrees prior to entering the channel proper. The outwardly arched end portions 89 of the ribs 88 reduce the likelihood of air turbulence in the region of the inlet of the channel 87.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A hair dryer comprising a hood defining at least one plenum chamber and having a deformable foraminous panel adjacent said chamber and arranged to at least partially surround the hair on the head of a person wearing the hood; and an apparatus for supply air into said chamber including a housing having a plurality of walls at least one of which has ports for admission of air into said housing, means for conveying the thus admitted air from said housing into said chamber, and means for directing air which enters the housing via said ports to said conveying means, said directing means being located within and being rigid with said housing and being spaced apart from at least some of said ports.

2. The hair dryer of claim 1, wherein said directing means is integral with said housing.

3. The hair dryer of claim 2, wherein said directing means comprises internal projections provided on at least one of said walls in said housing.

4. The hair dryer of claim 3, wherein said projections define a channel for the flow of air to said conveying means.

5. The hair dryer of claim 4, wherein said projections include elongated ribs.

6. The hair dryer of claim 4, wherein said conveying means comprises an electric motor and said apparatus further comprises a bearing for said motor, said bearing being disposed in said housing and defining with said projections a clearance for admission of air from said housing into said channel.

7. The hair dryer of claim 6, wherein said clearance is an annular gap.

8. The hair dryer of claim 6, wherein said bearing has a tubular skirt and said projections have end portions adjacent said skirt, said clearance being disposed between said end portions and said skirt.

9. The hair dryer of claim 8, wherein said end portions together form a collar which surrounds a portion of said skirt.

10. The hair dryer of claim 6, wherein said housing includes an end wall which is remote from said clearance and said channel has an enlarged inlet adjacent said end wall.

11. The hair dryer of claim 10, wherein said projections have arcuate end portions defining said inlet.

12. A hair dryer comprising a hood defining at least one plenum chamber and having a deformable foraminous panel adjacent said chamber and arranged to at least partially surround the hair on the head of a person wearing the hood; and an apparatus for supplying air into said chamber including a housing having a plurality of walls at least one of which has ports for admission of air into said housing, means for conveying the thus admitted air from said housing into said chamber, said conveying means comprising an electric motor, a bearing for said motor, and means for directing air which enters the housing via said ports to said conveying means, said directing means being integral with said housing and comprising internal projections provided on at least one of said walls in said housing, said projections defining a channel for the flow of air to said conveying means, said bearing being disposed in said housing and defining with said projections a clearance for admission of air from said housing into said channel, said bearing having a tubular skirt and said projections having end portions adjacent said skirt, said clearance being disposed between said end portions and said skirt.

13. The hair dryer of claim 12, wherein said end portions together form a collar which surrounds a portion of said skirt.

* * * * *